United States Patent [19]

James

[11] Patent Number: 4,990,059

[45] Date of Patent: Feb. 5, 1991

[54] METHOD FOR FILTERING LIQUID-PHASE METALS

[75] Inventor: Richard S. James, Gibsonia, Pa.

[73] Assignee: Aluminum Company of America, Pittsburgh, Pa.

[21] Appl. No.: 286,157

[22] Filed: Dec. 19, 1988

[51] Int. Cl.[5] ..... B22D 37/100

[52] U.S. Cl. ..... 417/50; 75/671; 75/708; 75/10.67; 266/234; 266/237; 266/227; 210/510.1; 310/11

[58] Field of Search ..... 417/50; 310/11; 75/68 R, 93 R, 10.67; 222/590, 594; 266/234, 237, 227; 210/510.1

[56] References Cited

U.S. PATENT DOCUMENTS

| | | | |
|---|---|---|---|
| 2,786,416 | 3/1957 | Fenemore | 103/1 |
| 2,929,326 | 3/1960 | Ingels | 103/1 |
| 3,090,094 | 5/1963 | Schwartzwalder et al. | 25/156 |
| 3,097,930 | 7/1963 | Holland | 25/156 |
| 3,524,548 | 8/1970 | McDonald et al. | 210/510.1 |
| 3,706,399 | 12/1972 | Sundberg | 417/50 |
| 3,767,090 | 10/1973 | Sundberg et al. | 417/50 |
| 3,893,917 | 7/1975 | Pryor | 210/69 |
| 3,947,363 | 3/1976 | Pryor et al. | 210/510 |
| 3,962,081 | 6/1976 | Yarwood et al. | 210/69 |
| 4,024,056 | 5/1977 | Yarwood et al. | 210/69 |
| 4,024,212 | 5/1977 | Dore et al. | 264/44 |
| 4,032,124 | 6/1977 | Yarwood et al. | 266/218 |
| 4,052,198 | 10/1977 | Yarwood et al. | 75/68 R |
| 4,056,586 | 11/1977 | Pryor et al. | 264/44 |
| 4,075,303 | 2/1978 | Yarwood et al. | 264/44 |
| 4,081,371 | 3/1978 | Yarwood et al. | 210/69 |
| 4,081,371 | 3/1978 | Yarwood et al. | 210/69 |
| 4,212,592 | 7/1980 | Olich et al. | 417/50 |
| 4,213,494 | 7/1980 | Carbonnel | 164/500 |
| 4,251,239 | 2/1981 | Clyde et al. | 55/132 |
| 4,265,659 | 5/1981 | Blome | 75/93 R |
| 4,342,664 | 8/1982 | Blome | 252/313 R |
| 4,343,704 | 8/1982 | Brockmeyer | 210/509 |
| 4,401,295 | 8/1983 | Yoshida | 75/68 R |
| 4,568,595 | 2/1986 | Morris | 428/116 |
| 4,714,494 | 12/1987 | Eckert | 75/68 R |
| 4,733,714 | 3/1988 | Smith | 164/130 |
| 4,817,918 | 4/1989 | Mochizuki et al. | 266/227 |
| 4,828,460 | 5/1989 | Saito et al. | 417/50 |

*Primary Examiner*—Leonard E. Smith
*Assistant Examiner*—David W. Scheuermann
*Attorney, Agent, or Firm*—David W. Pearce-Smith

[57] ABSTRACT

A method and apparatus is provided for filtering liquid-phase metal. The method comprises the steps of: (1) establishing a bath of liquid-phase metal; (2) providing a conduit connecting the bath to a filtering means; and (3) producing a magnetic field within the conduit to produce axial flow of the liquid-phase metal within the conduit to transfer at least a portion of the liquid-phase metal to the filtering means and cause at least a portion of the liquid-phase metal to flow through the filtering means.

4 Claims, 1 Drawing Sheet

METHOD FOR FILTERING LIQUID-PHASE METALS

TECHNICAL FIELD

This invention relates to electromagnetic pumps. More particularly, the invention relates to the use of electromagnetic pumps for filtering liquid-phase metals.

BACKGROUND ART

Molten or liquid-phase metal, particularly molten aluminum, in practice generally contains entrained solids which are deleterious to the final cast metal product. These entrained solids appear as inclusions in the final cast product after the molten metal is solidified and cause the final product to be less ductile or to have poor bright finishing and anodizing characteristics. The inclusions may originate from several sources. For example, the inclusions may originate from surface oxide films which become broken up and are entrained in the resultant molten metal. In addition, inclusions may originate as insoluble impurities, such as carbides, borides and others, or eroded furnace and trough refractories.

The filtering of molten metal to remove impurities is routinely done before casting, especially in the casting of aluminum. Heretofore, the filtering is accomplished by pouring the molten metal into a vessel which has a filter on or near its lower surface and allowing the force of gravity to cause the molten metal to flow through the filter. These processes suffer from one or more serious disadvantages making them less than entirely optimal for use with molten metals.

Among the disadvantages of existing processes are that they can be slow since they are dependent on the force of gravity to pull the liquid-phase metal through the filtering means. Often the option to use many filters is not available because of the low permeability of the filtration media.

In addition, prior processes which depend on gravity to pull the liquid-phase metal through the filtering means clog quickly because the change in pressure available to force the metal through is low and cannot be adjusted as the filter starts to plug.

Furthermore, many prior processes which are not dependent on gravity to generate the pressure differential to force the liquid-phase metal through the filtering means require the use of equipment with moving parts, bearings and seals which eventually need to be replaced. Downtime due to maintenance of this equipment adds to the overall cost of production.

It is known that liquid-phase metals can be circulated by electromagnetic pumps. Electromagnetic pumps are pumps which operate on the principle that a force is exerted on a conductor (the liquid) carrying current in a magnetic field. The high electrical conductivity of liquid metals makes it possible to pump them by magnetic means. Various electromagnetic pumps have been found to be useful in the heating, mixing and casting of metals.

Electromagnetic pumps may be either a direct-current(dc) conduction pump or an alternating-current(ac) induction pump. Direct-current conduction pumps are a direct application of the right-hand rule, which states that a current passing at right angles to a magnetic field will produce a force at right angles to both. This force, directed in the fluid, manifests itself as a pressure if the fluid is suitably contained. Pump performance of direct-current electromagnetic pumps depends upon the magnitude of the current, magnetic field intensity, and the geometry of the pump duct. The disadvantage of this type of pump is that very high current (thousands of amperes) at low voltage (1–2 volts) is required.

Large currents can also be developed in liquid metal by electromagnetic induction. Alternating-current induction pumps consist of a duct in the form of a flattened tube extending between two core sections containing a three-phase ac winding. The winding is similar to that of an induction motor stator except that the field structure is flat and a sliding rather than a rotating magnetic field is produced. The field windings must be cooled to protect the electrical insulation. Alternating-current pumps typically employ conventional power supplies (60-hertz ac) but variable power supplies may be used.

Examples of various electromagnetic pumps are disclosed in the following U.S. Pat. Nos. 2,786,416; 2,929,326; 4,212,592 and the references cited therein.

A principal object of the present invention is to provide a method and apparatus for filtering liquid-phase metal which does not suffer from the disadvantages and limitations of prior filtering methods and apparatus.

Another object of the present invention is to provide a method and apparatus for filtering liquid-phase metal which does not rely solely on the force of gravity to pull the liquid-phase metal through the filtering means.

Another object of the present invention is to provide a method and apparatus for filtering liquid-phase metal which will not clog quickly because the change in pressure available to force the metal through can be adjusted as the filter starts to plug.

Still another object of the present invention is to provide an apparatus for filtering liquid-phase metal that is capable of utilizing filters having a lower permeability than filters which have been used heretofore.

Yet another object of the present invention is to provide a method and apparatus for filtering liquid-phase metal which does not require pouring the metal and thereby minimizes the amount of liquid-phase metal which contacts the atmosphere.

A further object of the present invention is to provide a method and apparatus for filtering liquid-phase metal which minimizes production downtime due to maintenance of moving parts, bearings or seals which are required to transfer the liquid-phase metal to the filter.

A further object is to provide a means of varying pressure so that as the filter clogs, more pressure is applied in a controlled fashion to assure metal flow through the filter.

Additional objects and advantages of the invention will be more fully understood and appreciated with reference to the following description.

DISCLOSURE OF THE INVENTION

In accordance with the present invention, a method for filtering liquid-phase metal is provided which comprises the steps of: (1) establishing a bath of liquid-phase metal; (2) providing a conduit connecting the bath to a filtering means; and (3) producing a magnetic field within the conduit to produce axial flow of the fluid within the conduit to transfer at least a portion of the liquid-phase metal to the filtering means and cause at least a portion of the liquid-phase metal to flow through the filtering means.

The apparatus of the present invention comprises: (1) a chamber for holding liquid-phase metal; (2) a filtering means for filtering impurities from the liquid-phase metal; (3) a conduit having an inlet end in fluid communication with the chamber and an outlet end in fluid communication with the filtering means; and (3) a means for producing a magnetic field within the conduit to produce axial flow of the liquid-phase metal within the conduit and thereby transfer at least a portion of the liquid-phase metal to flow to the filtering means and cause at least a portion of the liquid-phase metal to flow through the filtering means.

In a preferred embodiment of the present invention, it is contemplated that the liquid-phase metal may be a molten metal such as aluminum, copper, steel or alloys thereof. It is also contemplated that the means for producing a magnetic field may be an electromagnetic pump operating under ac or dc current.

Some suitable filters for use in the present invention are open-pore, ceramic foam filters currently used in the processing of molten metals such as steel and aluminum. Examples of such ceramic filters are disclosed, for example, in the following U.S. Pat. Nos. 3,090,094; 3,097,930; 3,893,917; 3,947,363; 3,962,081; 4,024,056; 4,024,212; 4,032,124; 4,052,198; 4,056,586; 4,075,303; 4,081,371; 4,265,659; 4,342,664; 4,343,704; 4,251,239; 4,568,595 and the references cited therein.

BRIEF DESCRIPTION OF THE DRAWINGS

Other features of the present invention will be further described or rendered obvious in the following related description of the preferred embodiment which is to be considered together with the accompanying drawings, wherein like figures refer to like parts and further wherein.

MODE FOR CARRYING OUT THE INVENTION

Figure 1:
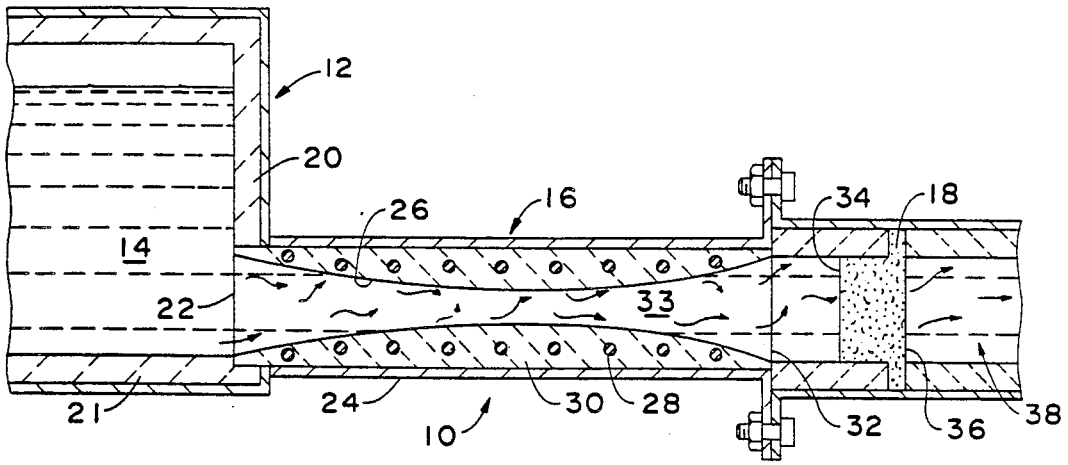
FIG. 1 is a side cutaway view of the preferred embodiment of the present invention.

Looking first to FIG. 1, there is shown a side cutaway view of the filtering system 10 of the present invention. The filtering system 10 comprises a chamber 12 containing liquid-phase metal 14, a turbulence pumping conduit 16 and a replaceable filter 18.

Chamber 12 is a tank for holding liquid-phase metal 14. Chamber 12 is comprised of sidewalls 20 and bottom wall 21. The composition of the sidewalls 20 used will depend upon the nature of the specific liquid-phase metal to be filtered. For convenience, liquid-phase metal 14 will be referred to as molten metal 14 hereinafter. If liquid-phase metal is molten metal 14, sidewalls 20 will need to be made of material capable of withstanding the high temperatures normally associated with the processing of molten metal. These refractory materials are well known to those skilled in the art of metallurgy.

Turbulence pumping conduit 16 is connected to chamber 12 at inlet end 22. Turbulence pumping conduit 16 comprises a stainless steel cylindrical outer wall 24, which acts as a housing for the conduit, an inner wall 26, insulation 30 located between inner and outer walls 24 and 26, windings 28 and outlet end 32. Windings 28 are positioned uniformly along the length of the conduit 16 and encircle inner wall 26. Inner wall 26 is conical at each of its ends and forms passageway 33 through which molten metal 14 travels on its way to filter 18.

The outlet end 32 of turbulence pumping conduit 16 is connected to the inlet side 34 of filter 18. The outlet side 36 of filter 18 is connected to conduit 38 which leads to the next step in the processing of the molten metal. Filters suitable for use in the present invention are, for example, those sold under the trademark Selee, products of Consolidated Aluminum Co. of St. Louis, MO. These filters are open-pore, ceramic foam and are manufactured according to techniques as disclosed, for example, in the following U.S. Pat. Nos. 3,090,094; 3,097,930; 3,893,917 and 3,947,363.

In operation, a molten aluminum metal alloy is held in chamber 12 at a temperature of between approximately 1250° F. to 1500° F., and preferably about 1375° F., until it is ready to be cast. Current is supplied to windings 28 to generate a magnetic field within conduit 16 and impart a forward motion to the molten metal. Turbulence may be generated within conduit 16 as a result of an uneven distribution of magnetic forces inside the pump which create a whirlpool effect. This turbulence is considered to be desirable in that it further mixes molten metal 14. However, devices are available in the art to mitigate turbulence, for example, appropriately place vanes.

The pressure generated within the conduit causes the molten metal to be transferred toward and through outlet end 32 and through filter 18. Filter 18 can be situated in a variety of locations downstream from the molten metal flow produced by pumping conduit 16 so long as it removes the impurities in the molten metal before it is transferred to forming operations such as casting, rolling, forging, extrusion, etc.

Figure 2:
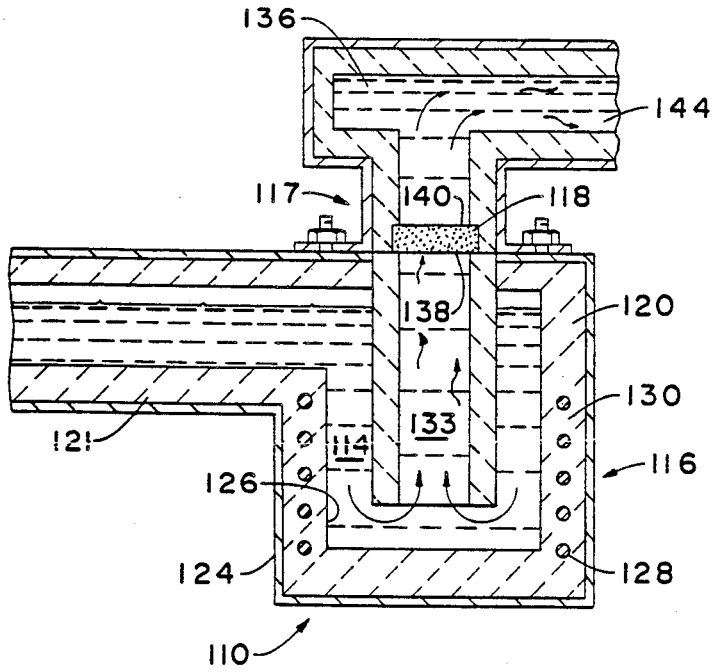
FIG. 2 is a side cutaway view of a second preferred embodiment of the present invention.

Referring now to FIG. 2, there is illustrated a cutaway view of a second preferred embodiment of the present invention. The filtering system 110 comprises a chamber 112 containing liquid-phase metal 114, a turbulence pumping conduit 116, a conduit 117 and a filter 118.

Chamber 112 is a tank for holding liquid-phase metal 114. Chamber 112 is comprised of sidewalls 120 and bottom wall 121. The composition of the sidewalls 120 used will depend upon the nature of the specific liquid-phase metal. For convenience, liquid-phase metal 114 will be referred to as molten metal 114 hereinafter. If liquid-phase metal is molten metal 114, sidewalls 120 will need to be made of material capable of withstanding the high temperatures normally associated with the processing of molten metal. These refractory materials are well known to those skilled in the art of metallurgy.

Turbulence pumping conduit 116 is an electromagnetic pump located below the level of bottom wall 121 of chamber 112. Turbulence pumping conduit 116 comprises an outer wall 124, an inner wall 126, insulation 130 located between inner and outer walls 124 and 126 and windings 128. Windings are positioned uniformly along the length of the conduit 128 and encircle inner wall 126.

Conduit 117 is a cylindrical duct which forms passageway 133 through which the liquid-phase metal travels on its way to filter 118. Conduit 117 has a first end which is located within inner wall 126 of pumping conduit 116 and extends upward above the level of molten metal 114 to a passageway which leads to the next step in the processing of molten metal 14.

In operation, a molten aluminum metal alloy is held in chamber 112 at a temperature of between approximately 1250° F. to 1500° F. and preferably about 1375° F. until it is ready to be cast. Current is supplied to windings 128 to generate a magnetic field within conduit 116 and impart an upward motion to the molten metal. Turbulence may be generated within conduit 116 as a result of an uneven distribution of magnetic forces inside the pump which create a whirlpool effect. This turbulence is considered to be desirable in that it further mixes molten metal 114. The pressure generated within the conduit causes molten metal to flow upward through conduit 117 and into filter 118 under the pressure created by pumping conduit 116. Filter 118 removes the impurities in the molten metal, and the metal then flows along conduit 136 so that it may be processed according to methods well known to the art.

It is to be appreciated that the pressure generated by the electromagnetic pump which causes molten metal to flow through the conduit may be adjusted as the filter starts to plug. In addition, the pressure generated within the conduit may be adjusted so that it is much greater than pressure from the force of gravity. This will permit those skilled in the art to utilize a wider variety of filters than have been used heretofore. Those skilled in the art will appreciate that the present invention will permit them to use filters having a much lower permeability than filters to which they have been restricted.

It is also to be appreciated that certain features of the pumping system may be made without departing from the present invention. Thus, for example, the pumping conduit can be rotated to cause molten metal to flow in directions other than those described above. The pumping conduit of FIG. 1 may be rotated 45 degrees upward to cause the molten metal to flow upward at a 45 degree angle. Similarly, the pumping conduit of FIG. 1 may be rotated 45 degrees downward to cause the molten metal to flow downward at a 45 degree angle.

It is contemplated that the filter used need not be a single vertical filter. For example, one may use multistage filters or a series of filter plates with a filter having a larger pore size utilized upstream from a second filter having a smaller relative pore size so that the upstream filter removes gross inclusions and the downstream filter removes smaller inclusions. In addition, the filter need not be substantially vertically disposed but may be horizontally disposed or at an intermediate angle with respect to the flow of the molten metal.

It is anticipated that either alternating-current or direct-current may be used to pump molten metal.

Furthermore, it is also anticipated that other than cylindrical conduits may be used to pump the molten metal.

These and other changes of the types described could be made to the pumping system without departing from the spirit of the invention. The scope of the present invention is indicated by the broad general meaning of the terms in which the claims are expressed.

What is claimed is:

1. A method for filtering liquid-phase metal, comprising the steps of:

establishing a bath of liquid-phase metal;

providing a conduit connecting said bath to a filtering means; and producing a magnetic field within said conduit to;

(a) supplement the force of gravity.

(b) produce axial flow of said liquid-phase metal within said conduit at a pressure greater than would occur from the force of gravity acting to move said molten metal through said filter metal and (c) to transfer at least a portion of said liquid-phase metal through said filtering means.

2. The method of claim 1 in which said step of establishing a bath of said liquid-phase metal includes:

heating a metal to a molten state.

3. The method of claim 1 in which said step of establishing a bath of said liquid-phase metal includes:

heating aluminum to its molten state.

4. The method of claim 1 in which said step of providing a conduit connecting said bath and said filtering means includes:

an outer cylinder;

an inner wall;

a layer of a refractory ceramic material disposed between said outer cylinder and said inner wall; and windings for producing said magnetic field.

* * * * *

UNITED STATES PATENT AND TRADEMARK OFFICE

CERTIFICATE OF CORRECTION

PATENT NO. : 4,990,059

DATED : February 5, 1991

INVENTOR(S) : Richard S. James

It is certified that error appears in the above-identified patent and that said Letters Patent is hereby corrected as shown below:

| | |
|---|---|
| Claim 1, Col. 6, line 24 | After "filter" delete "metal". |

Signed and Sealed this

Twenty-eighth Day of July, 1992

*Attest:*

DOUGLAS B. COMER

*Attesting Officer*

*Acting Commissioner of Patents and Trademarks*